US006547634B1

(12) United States Patent
Chen

(10) Patent No.: US 6,547,634 B1
(45) Date of Patent: Apr. 15, 2003

(54) TOY CAR

(75) Inventor: Ting-Hsing Chen, Tainan Hsien (TW)

(73) Assignee: Far Great Plastics Industrial Co., Ltd., Tainan Hsien (TW)

( * ) Notice: Subject to any disclaimer, the term of this patent is extended or adjusted under 35 U.S.C. 154(b) by 0 days.

(21) Appl. No.: 10/142,825

(22) Filed: May 13, 2002

(51) Int. Cl.[7] ..... A63H 29/02

(52) U.S. Cl. ..... 446/462; 446/438; 446/129; 446/330

(58) Field of Search ..... 446/462, 440, 446/485, 438, 463–465, 129, 330, 353, 352, 358

(56) References Cited

U.S. PATENT DOCUMENTS 3,798,831 A * 3/1974 Higashi
3,798,832 A * 3/1974 Terzian
4,193,223 A * 3/1980 D'Andrade et al.
4,445,297 A * 5/1984 D'Andrade et al.
4,457,099 A * 7/1984 Kozuka et al. ..... 446/437
4,463,515 A * 8/1984 Barlow et al. ..... 446/409
5,112,267 A * 5/1992 Liu et al. ..... 446/470

* cited by examiner

*Primary Examiner*—Derris H. Banks
*Assistant Examiner*—Jamila Williams
(74) *Attorney, Agent, or Firm*—Rosenberg, Klein & Lee

(57) ABSTRACT

A toy car includes a car body, a transmission box and a generator device, the generator device has an inductive coil sleeved on a transmission shaft extending outward from the transmission box, and a magnet sleeved on the transmission shaft with respect to the inductive coil. When the transmission shaft rotates, the magnet and the inductive coil are in an opposition movement, which generates electric power to supply load, such as bulbs to produce a lighting effect.

1 Claim, 4 Drawing Sheets

TOY CAR

BACKGROUND OF THE INVENTION

1. Field of the Invention

This invention relates to a toy car, and more particular to a toy car with a self-generating device to reach a lighting effect of the car.

2. Description of the Prior Art

As shown in FIG. 4, a conventional toy car 1 on the market comprises a handle 10. By rotating the handle 10, a spindle 11 is linked to rotate and press a spring plate 12. When the handle 10 is released, the restoring force of the spring plate 12 drives the spindle 11 to rotate, which is meshed with a transmission gear set to drive wheels 14 to roll. Later, an improved toy car has added lights 15, which requires a battery 16 and a switch 17 to operate and increases the cost.

In view of this, the inventor has invented the present invention to improve the above-mentioned shortcomings.

SUMMARY OF THE INVENTION

It is the primary object of the present invention to provide a toy car, which transforms mechanical energy into electric power, and therefore saves energy and corresponds to environmental protection.

It is another object of the present invention to provide a toy car, which is simple in structure and manpower saving.

It is a further object of the present invention to provide a toy car, which generates a lighting effect to attract a consumer's interest.

DETAILED DESCRIPTION OF THE PREFERRED EMBODIMENT

Figure 1:
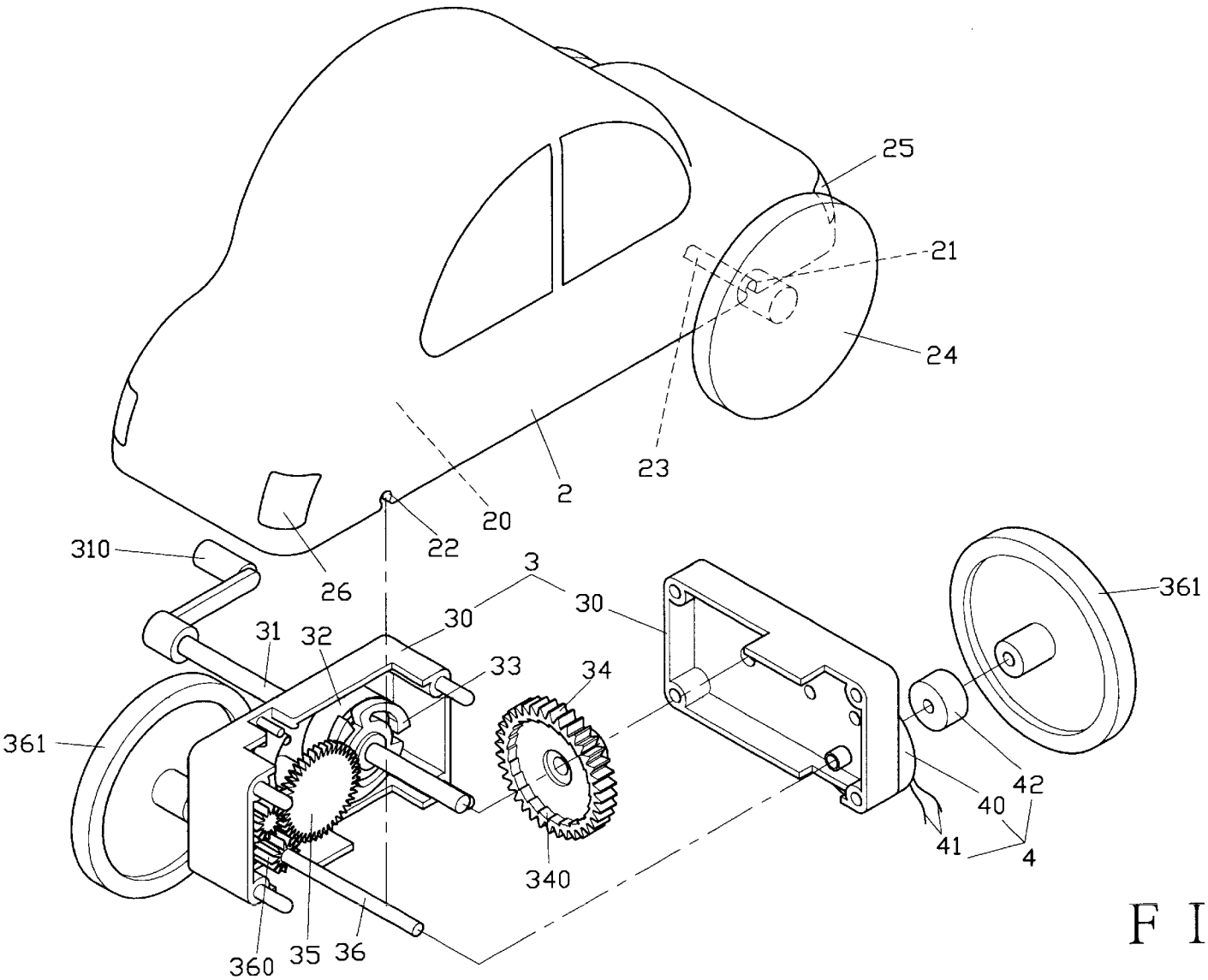
FIG. 1 is an exploded view of the present invention.

A toy car of the present invention comprises a car body 2, a transmission box 3, and a generator 4.

The car body has a recess 20 in the body and two holes 21 and 22 for transmission shafts 23 and 36 to seat therein, respectively. The transmission shaft 23 is secured with two wheels 24 at respective ends. The car body 2 further comprises headlights 25 and taillights 26.

A transmission box 3 seats in the recess 20 of the body 2 and comprises a pair of semi-boxes 30 which comprises a spindle 31 with one end secured with a handle 310. A spring plate 32 and a ratchet gear 33 are sleeved on the spindle 31 in sequence. A transmission gear 34 sleeves on the ratchet gear 33 with a single direction gear 340 meshing with the ratchet gear 33, which allows one direction only. The transmission gear 34 further meshes with a gear set 35, and the gear set 35 meshes with a driven gear 360 of a transmission shaft 36, thereafter. Both ends of the transmission shaft 36 are secured with two wheels 361.

A generator 4 located next to the transmission box 3 comprises an inductive coil 40 sleeved onto the transmission shaft 36 extending outwardly from the transmission box 30, electric wires 41 extending from the inductive coil 40 and a magnet 42. The electric wires 41 are connected to the headlights 25 and the taillights 26, respectively. The magnet 42 relative to the inductive coil 40 is sleeved on the transmission shaft 36.

Figure 2:
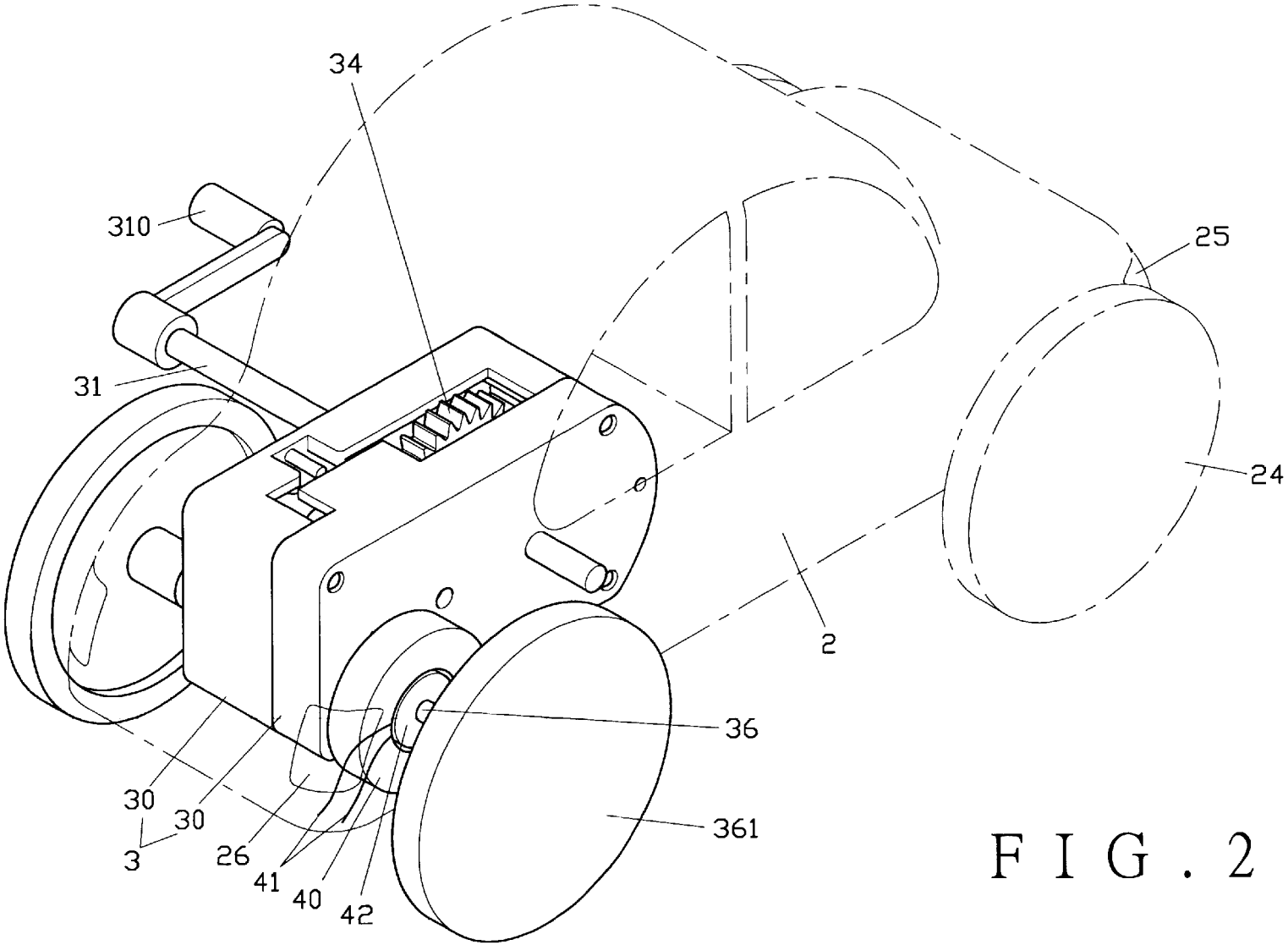
FIG. 2 is a perspective view of the present invention.

To assemble the present invention, the transmission box 3 is set into the recess 20 of the body 2, as shown in FIG. 2, and then the transmission shafts 21 and 36 are inserted into the holes 21 and 22, respectively. The electric wires 41 to connected to the headlights 25 and the taillights 26, and the ratchet gear 33 meshes with the single direction gear 340 of the transmission gear 34 which meshes with the gear set 35. The gear set 35 then meshes with the driven gear 360 of the transmission shaft 36.

Figure 3:
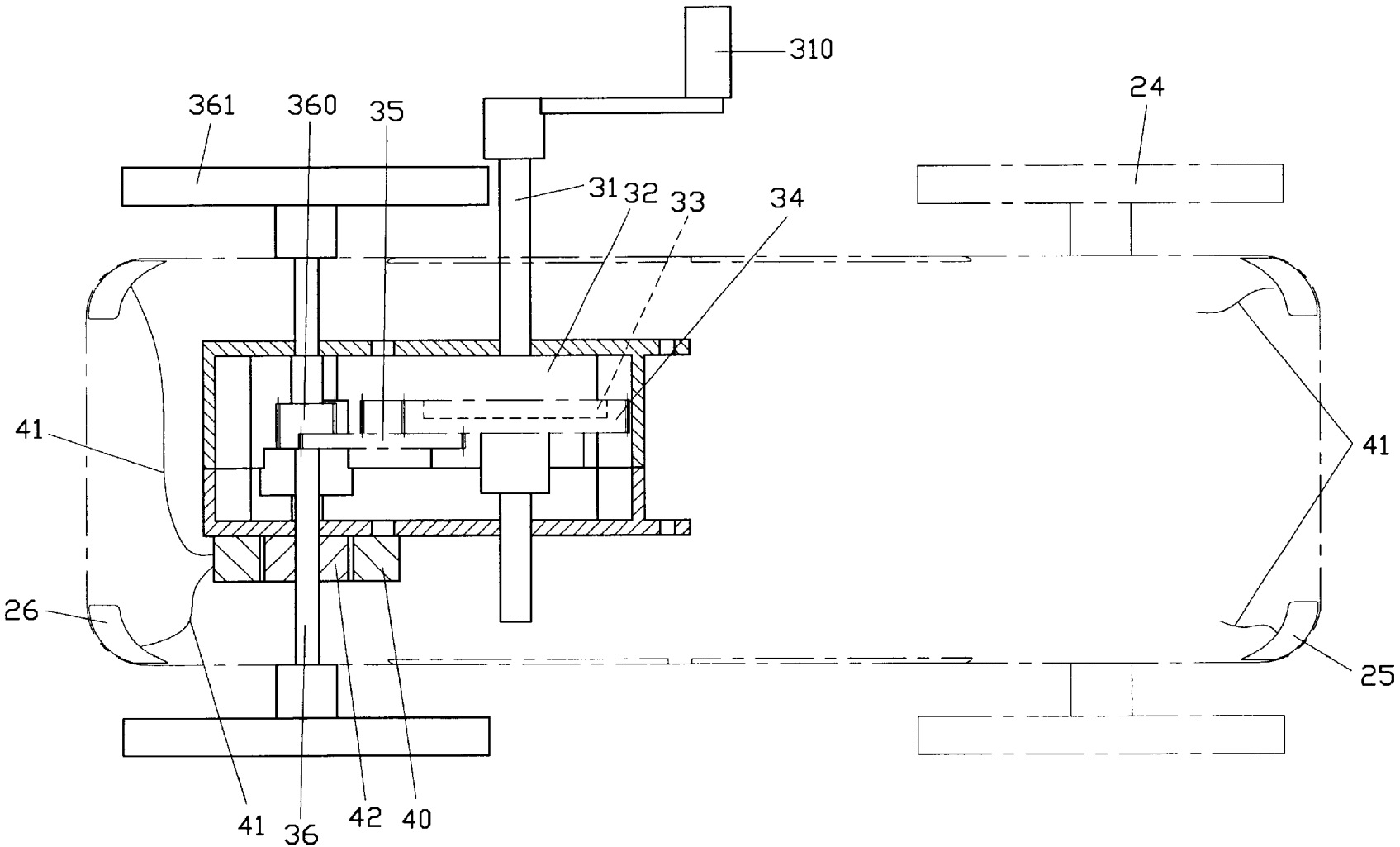
FIG. 3 is a view showing operating the toy car incorporated with the present invention.
Figure 4:
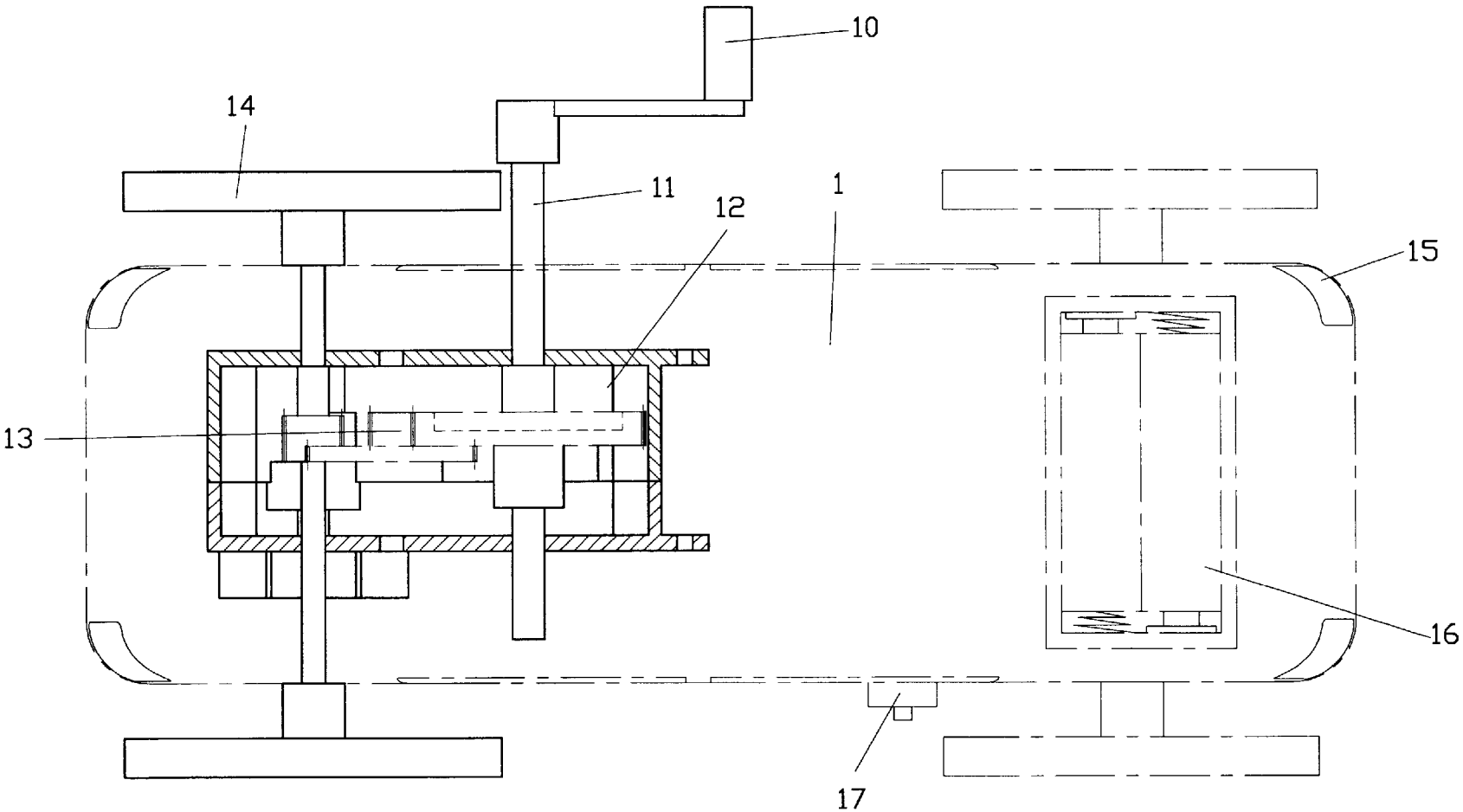
FIG. 4 (PRIOR ART)
FIG. 4 is a top view of a prior toy car.

To operate the present invention, the handle 310 is spun to rotate the spindle 31 and press the spring plate 32, as shown in FIG. 3. Due to the ratchet gear 33 on the spindle 31 goes in a single direction, the transmission gear 34 does not follow this movement. When the handle 310 is released, the restoring force of the spring plate 32 brings the spindle 31 to rotate reversely, whereas the ratchet gear 33 on the spindle 31 links the transmission gear 34, the gear set 35, the driven gear 360, the transmission shaft 36 and the wheels 361 to rotate simultaneously. The rotation of the transmission shaft 36 drives not only the rotation of the wheels 361 but also the rotation of the magnet 42. The magnet 42 on the transmission shaft 36 rotates in a counter direction with respect to the inductive coil 40 to generate electric power. This electric power activates the headlights 25 and the taillights 26 through the electric wires 41.

I claim:

1. A toy car comprising a car body having a recess therein, a pair of holes for a pair of transmission shafts to seat therein, said car body further comprising wheels at respective sides and headlights and taillights, a transmission box being formed by a pair of semi-boxes, and to be seated in said recess of said body, said transmission box comprising a spindle with a handle at one end, a spring plate and a ratchet gear sleeved on said spindle, said ratchet gear meshing with a transmission gear having a single direction gear therein, said transmission gear meshing with a gear set, said gear set meshing with a driven gear of a transmission shaft, both of said transmission shafts being secured with said wheels at respective ends, and being characterized in that, a generator being secured to one side of said transmission box, having an inductive coil sleeved onto one end of said transmission shaft extending from said transmission box, said inductive coil having extending electric wires connected to said headlights and said taillights, a magnet relative to said inductive coil being sleeved on said transmission shaft.

* * * * *